US006698711B2

(12) United States Patent
Mattes

(10) Patent No.: US 6,698,711 B2
(45) Date of Patent: Mar. 2, 2004

(54) VALVE FOR CONTROLLING FLUIDS

(75) Inventor: Patrick Mattes, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 66 days.

(21) Appl. No.: 10/018,523

(22) PCT Filed: Feb. 13, 2001

(86) PCT No.: PCT/DE01/00534

§ 371 (c)(1),
(2), (4) Date: Feb. 22, 2002

(87) PCT Pub. No.: WO01/81752

PCT Pub. Date: Nov. 1, 2001

(65) Prior Publication Data

US 2003/0098428 A1 May 29, 2003

(30) Foreign Application Priority Data

Apr. 20, 2000 (DE) ..... 100 19 764

(51) Int. Cl.[7] ..... F02M 37/04
(52) U.S. Cl. ..... 251/57; 239/102.2
(58) Field of Search ..... 251/57, 129.06; 239/102.2

(56) References Cited

U.S. PATENT DOCUMENTS 3,648,967 A * 3/1972 O'Neill et al. ..... 251/57
4,762,300 A * 8/1988 Inagaki et al. ..... 251/129.06
5,779,149 A * 7/1998 Hayes, Jr. ..... 239/124
6,062,532 A * 5/2000 Gurich et al. ..... 251/57
6,155,532 A * 12/2000 Heinz et al. ..... 251/57
6,427,664 B1 * 8/2002 Boecking ..... 123/446
6,427,968 B1 * 8/2002 Stoecklein ..... 251/57
6,530,555 B1 * 3/2003 Stoecklein et al. ..... 251/57
6,547,213 B1 * 4/2003 Heinz et al. ..... 251/57

* cited by examiner

*Primary Examiner*—Gene Mancene
*Assistant Examiner*—Eric Keasel
(74) *Attorney, Agent, or Firm*—Ronald E. Greigg

(57) ABSTRACT

A valve for controlling fluids having an actuator unit for actuating a valve member, which has a first piston and a second piston, separated from it by a hydraulic chamber, and which actuates a valve closing member that divides a low-pressure region at system pressure from a high-pressure region. For leakage compensation, a filling device connectable to the high-pressure region is provided with a hollow chamber, in which a throttle body is disposed such that a line leading to the high-pressure region discharges into the hollow chamber on one end of the throttle body, and on the other end a system pressure line leading to the hydraulic chamber branches off. The system pressure is built up by geometric definition of a throttle bore in the throttle body and of the dimensions of the piston, along which the system pressure is reduced, as a function of a prevailing pressure in the high-pressure region. Alternatively, a second throttle body can be provided in the hollow chamber, and this throttle body has a throttle bore which is preceded by a leakage line branching off from the hollow chamber, and along which throttle body the system pressure is reduced.

18 Claims, 3 Drawing Sheets

VALVE FOR CONTROLLING FLUIDS

CROSS-REFERENCE TO RELATED APPLICATIONS

This application is a 35 USC 371 application of PCT/DE 01/0534 filed on Feb. 13, 2001.

BACKGROUND OF THE INVENTION

1. Field of the Invention

The invention is directed to valves for controlling fluids, in which a valve closing member divides a low-pressure region in the valve from a high-pressure region. Such valves are known in the industry in various embodiments, for example in fuel injectors, especially common rail injectors, or in pumps of motor vehicles.

2. Description of the Prior Art

Such a valve is also known from European Patent Disclosure EP 0 477 400 A1; the valve described in this reference is actuatable via a piezoelectric actuator and has an arrangement for a travel converter, acting in the stroke direction, of the piezoelectric actuator. The deflection of the actuator is transmitted via a hydraulic chamber, which serves as a hydraulic booster and as a tolerance compensation element. The hydraulic chamber encloses a common work volume between two pistons defining the hydraulic chamber, of which one piston is embodied with a smaller diameter and is connected to a valve closing member to be triggered, and the other piston is embodied with a greater diameter and is connected to the piezoelectric actuator. The hydraulic chamber is fastened between the pistons in such a way that the actuating piston executes a stroke that is lengthened by the boosting ratio of the piston diameter, when the larger piston is moved by a certain travel distance by means of the piezoelectric actuator. In addition, via the work volume of the hydraulic chamber, tolerances, resulting for instance from different temperature expansion coefficients of the materials used and possible settling effects, can be compensated for without the valve closing member's experiencing any change in its position.

To assure the function of such valves, the hydraulic system in the low-pressure region, in particular the hydraulic coupler, requires a system pressure. The system pressure drops because of leakage, unless hydraulic fluid is adequately replenished.

In common rail injectors known in the industry, for instance, in which the system pressure is expediently generated in the valve itself and is also kept as constant as possible upon a system start, the filling of the system pressure region is accomplished by the delivery of hydraulic fluid from the high-pressure region of the fuel to be controlled into the low-pressure region where the system pressure is to prevail. Often, the filling is done with the aid of leakage gaps, which are represented by leakage or filling pins. The system pressure is as a rule adjusted by means of a valve, and the system pressure can also be kept constant for a plurality of common rail valves, for example, as well.

However, if the system pressure in the hydraulic chamber is substantially constant, and is at least largely independent of the prevailing high pressure in the high-pressure region, this is problematic, since at high pressure values, great actuator force is required to open the valve closing member counter to the high-pressure direction; this dictates a correspondingly large, cost-intensive dimensioning of the actuator unit. Furthermore, at high pressure in the high-pressure region, the positive displacement of hydraulic volume out of the hydraulic chamber via the gaps surrounding the adjacent pistons is reinforced accordingly, meaning that under some circumstances, the refilling time for building up and maintaining the counterpressure on the low-pressure region is prolonged, so that for lack of complete refilling, in the event of a re-actuation of the valve soon thereafter, a shorter valve stroke will be executed, which can adversely affect the opening behavior of the entire valve.

SUMMARY OF THE INVENTION

The valve of the present invention for controlling fluids has the advantage that for refilling the hydraulic chamber, a system pressure dependent on the pressure level in the high-pressure region is furnished, and this system pressure assures the reliable function of the hydraulic chamber as a hydraulic booster. In a valve according to the invention, an increase in the system pressure is possible at a high pressure level in the high-pressure region in the hydraulic chamber, and as a result, the opening of the valve closing member counter to the high pressure applied is reinforced. In this way, compared to a valve with constant system pressure, a reduced triggering voltage of the actuator unit, preferably embodied as a piezoelectric unit, is sufficient. The valve according to the invention can therefore be equipped with a smaller and less-expensive actuator unit.

In addition, the invention makes a defined refilling of the low-pressure region, in particular the hydraulic chamber, possible. A very precise setting of the system pressure can be effected by flow changes at the throttle body, which are performed in an especially preferred way by hydroerosive rounding during assembly. The valve of the invention is thus distinguished not only by reliable furnishing of the requisite system pressure over the entire engine performance graph, but also by low costs for production and assembly. This is due above all to the structurally simple design of the valve, which makes it possible to define the variable system pressure in the hydraulic chamber by means of easily adjustable geometrical variables, such as the throttle flow and the dimensions of the body along which the system pressure is reduced to the low pressure.

Further advantages and advantageous features of the subject of the invention can be learned from the description, drawing and claims.

BRIEF DESCRIPTION OF THE DRAWINGS

Several exemplary embodiments of the valve of the invention for controlling fluids are shown in the drawing and will be explained in further detail in the ensuing description. Shown are.

DESCRIPTION OF THE PREFERRED EMBODIMENTS

Figure 1:
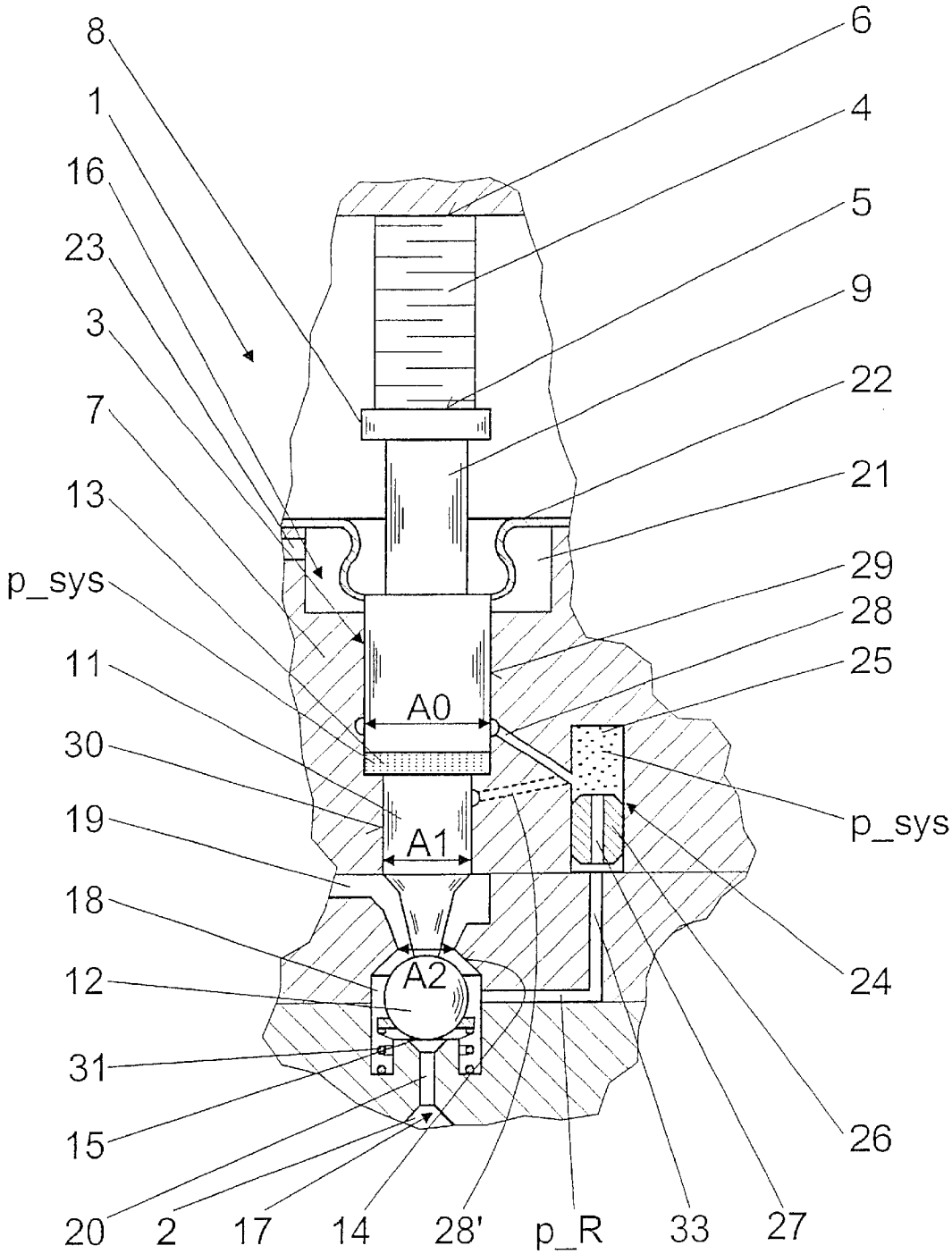
FIG. 1 is a schematic, fragmentary view of a first exemplary embodiment of the invention for a fuel injection valve for internal combustion engines, in longitudinal section.

The exemplary embodiment shown in FIG. 1 illustrates a use of the valve of the invention in a fuel injection valve 1 for internal combustion engines of motor vehicles. In the present embodiment, the fuel injection valve 1 is embodied as a common rail injector for injecting preferably Diesel fuel; the fuel injection is controlled via the pressure level in a valve control chamber 2, which communicates with a supply of high pressure. For adjusting the injection onset, a duration of injection, and an injection quantity via force ratios in the fuel injection valve 1, a valve member 3 is triggered via an actuator unit embodied as a piezoelectric actuator 4, which is disposed on the side of the valve member 3 remote from the valve control chamber and from the combustion chamber. The piezoelectric actuator 4 is constructed in the usual way in a plurality of layers, and on its side toward the valve member 3, it has an actuator head 5, while on its side remote from the valve member 3 it has an actuator foot 6, which is braced against a wall of a valve body 7. Via a support 8, a first piston 9 of the valve member 3, which will be called a control piston, rests on the actuator head 5. The valve member 3 is disposed axially displaceably in a longitudinal bore of the valve body 7 and in addition to the first piston 9 it includes a further, second piston 11, which actuates a valve closing member 12 and will therefore also be called an actuating piston.

The pistons 9 and 11 are coupled to one another by means of a hydraulic booster, which is embodied as a hydraulic chamber 13 and transmits the deflection of the piezoelectric actuator 4. The hydraulic chamber 13, between the two pistons 9 and 11 defining it, where the diameter A1 of the second piston 11 is less than the diameter A0 of the first piston 9, encloses a common compensation volume, in which a system pressure p_sys prevails. The valve member 3, its pistons 9 and 11, and the piezoelectric actuator 4 are located one after the other on a common axis, and the second piston 11 executes a stroke that is lengthened by the boosting ratio of the piston diameter when the larger, first piston 9 is moved a certain travel distance by means of the piezoelectric actuator 4.

The compensation volume of the hydraulic chamber 13 makes it possible to compensate for tolerances resulting from temperature gradients in the component or different temperature expansion coefficients of the materials used and possible settling effects, without affecting the position of the valve closing member 12 to be triggered.

The ball-like valve closing member 12 cooperates, on the end of the valve member 3 toward the valve control chamber 2, with valve seats 14, 15 embodied on the valve body 7; the valve closing member 12 divides a low-pressure region 16 that is at the system pressure p_sys from a high-pressure region 17 that is at a high pressure or rail pressure p_R. The valve seats 14, 15 are embodied in a valve chamber 18, formed by the valve body 7, from which a leakage outlet conduit 19 leads away on the side of the valve seat 14 toward the piezoelectric actuator 4. On the high-pressure side, the valve chamber 18 can be made to communicate with the valve control chamber 2 of the high-pressure region 17, via the second valve seat 15 and an outlet throttle 20. The valve control chamber 2 is merely suggested in FIG. 1. In it there is a movable valve control piston, not identified by reference numeral. By the axial motions of this piston, the injection behavior of the fuel injection valve 1 is controlled in a manner known per se; typically, the valve control chamber 2 communicates with an injection line, which communicates with a high-pressure reservoir (common rail) that is common to a plurality of fuel injection valves.

On the end of the bore toward the piezoelectric actuator is a further valve chamber 21, which is defined by the valve body 7, the first piston 9, and a sealing element 22 that is connected to both the first piston and the valve body 7. The sealing element 22, embodied here as a bellowslike diaphragm, prevents the piezoelectric actuator 4 from coming into contact with the fuel contained in the low-pressure region 16. For removal of leakage fluid, a leakage line 23 branches off from the valve chamber 21.

To compensate for leakage losses on the low-pressure region 16 upon an actuation of the fuel injection valve 1, a filling device 24 which communicates with the high-pressure region 17 is provided. The filling device 24 is embodied with a channel-like hollow chamber 25, in which a pinlike throttle body 26 with a continuous throttle bore 27 is press-fitted into place. On the high-pressure end of the throttle body 26, a line 33 leading to the high-pressure region 17 discharges into the hollow chamber 25, while on the opposite end of the throttle body 26, a system pressure line 28 leading to the hydraulic chamber 13 branches off from the hollow chamber 25. a line 27 leading to the high-pressure region 17 discharges into the hollow chamber 25, while on the opposite end of the throttle body 26, a system pressure line 28 leading to the hydraulic chamber 13 branches off from the hollow chamber 25.

In the preferred embodiments shown in the drawing, the system pressure line 28 in each case discharges into a gap 29, surrounding the first piston 9, by way of which gap the system pressure is reduced toward the valve chamber 21 and the leakage line 23. However, it can also be provided that as an alternative or in addition, the system pressure line 28 discharges into a gap 30, surrounding the second piston 11, as indicated by dot-dashed lines for the line 28' in the drawings. In each case, the indirect filling of the hydraulic chamber 13 serves to improve the pressure holding capacity in the hydraulic chamber 13 during the triggering, but it is understood that it is also possible for the hydraulic chamber 13 to be filled directly via the system pressure line 28.

The system pressure p_sys, in the fuel injection valve 1 of the invention shown in FIG. 1, is built up as a function of the prevailing pressure p_R in the high-pressure region 17 by geometric definition of the throttle bore 27 in the throttle body 26 and of the dimensions, that is, the length and the diameter A0, of the first piston 9 along which the system pressure p_sys is reduced toward the low-pressure region 16.

By a change in the flow cross section of the throttle bore 27, for instance effected by hydroerosive rounding, the coupler pressure or system pressure p_sys can be adjusted during assembly such that it varies as a function of the pressure p_R prevailing in the high-pressure region 17. The system pressure p_sys that is attained after an injection following a certain refilling time must not exceed a maximum allowable static system pressure or coupler pressure that would lead to automatic valve opening without triggering of the piezoelectric unit 4. The gap sizes at the pistons 9 and 11 are also dimensioned accordingly. The diameter A0 of the first piston 9 and the diameter A1 of the second piston 11 are thus parameters for the geometric definition of the throttle body 26 and the first piston 9. Other parameters for their geometric definition are, besides the diameter ratio of the pistons 9 and 11, a seat diameter A2 of the first valve seat 14 and a spring force F_F of a spring 31, which in the present case is disposed between the valve closing member 12 and the second valve seat 15 and keeps the valve closing member 12 in the closing position on the first valve seat 14 upon relief of the high-pressure region 17.

Figure 2:
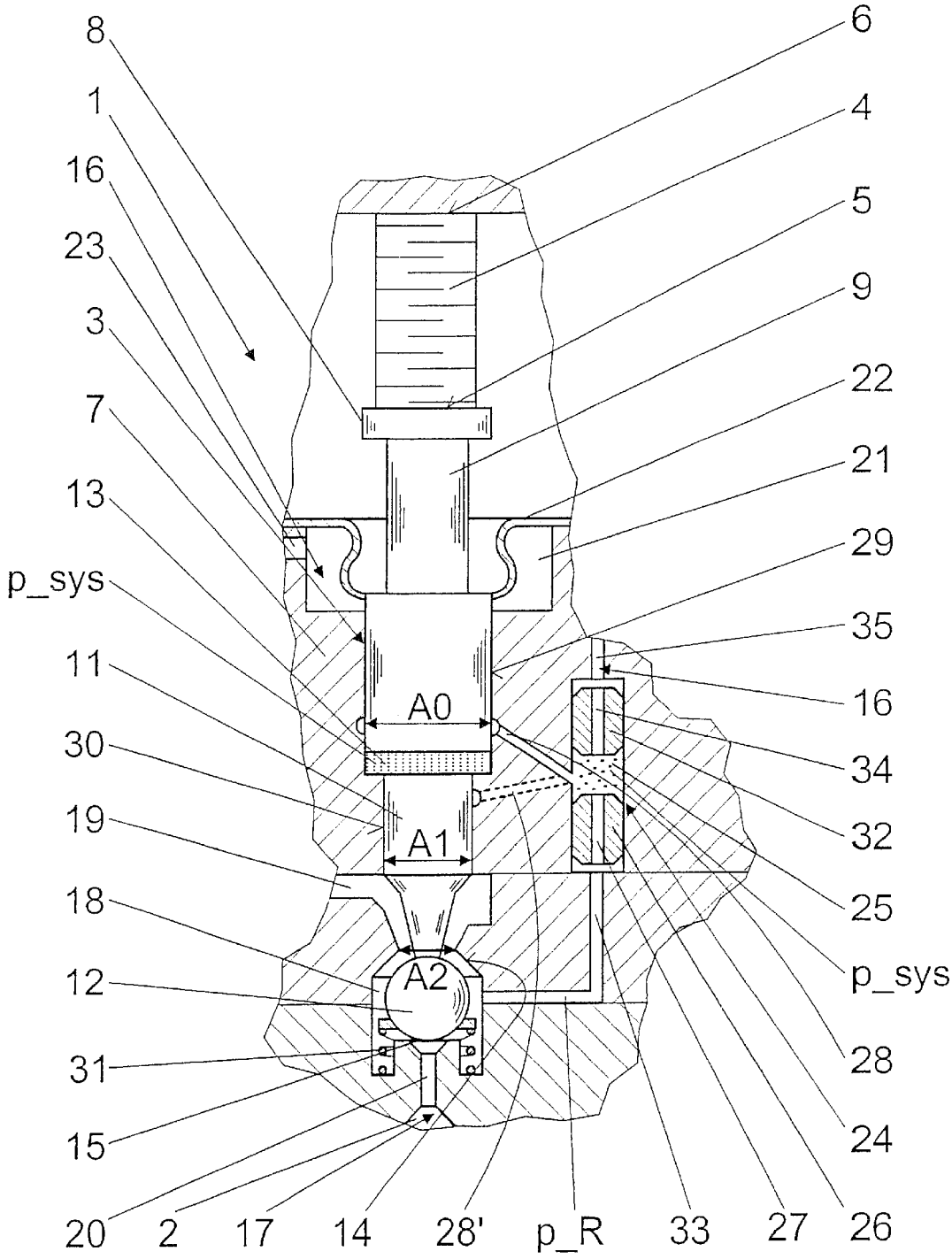
FIG. 2 is a view similar to FIG. 1 showing exemplary embodiment of the invention, in longitudinal section.

Referring now to FIG. 2, a detail of a further exemplary embodiment of the fuel injection valve is shown, which in principle functions like the fuel injection valve shown in FIG. 1. For the sake of simplicity, functionally identical components are identified by the same reference numerals as in FIG. 1.

Compared to the version of FIG. 1, in which the high pressure p_R toward the low-pressure region 16 is reduced via an in-line connection of the throttle body 26 and the first piston 9, in this version the function of the pressure reduction along the piston 9 is alternatively achieved by means of a further throttle body 32. This throttle body 32, likewise embodied in sleevelike fashion with a throttle bore 34, is press-fitted into the hollow chamber 25, which also receives the first throttle body 26, and it precedes a leakage line 35 that branches off directly from the hollow chamber 25. Between the throttle bodies 26 and 32, the system pressure p_sys builds up in the hollow chamber 25 as well as in the system pressure line 28 and the hydraulic chamber 13 as a function of the prevailing pressure p_R in the high-pressure region 17. The system pressure p_sys is reduced here along the second throttle body 32 to the low-pressure region 16. In the version shown in FIG. 2 as well, the possibility exists of adjusting the system pressure in the hydraulic chamber 13 in a simple way by purposeful adaptation of the throttle bores 27 and 34, which is accomplished for instance by hydroerosive rounding. As soon as the first throttle body 26 becomes cavitated, the system pressure p_sys and the incident leakage are limited to a maximum value.

Figure 3:
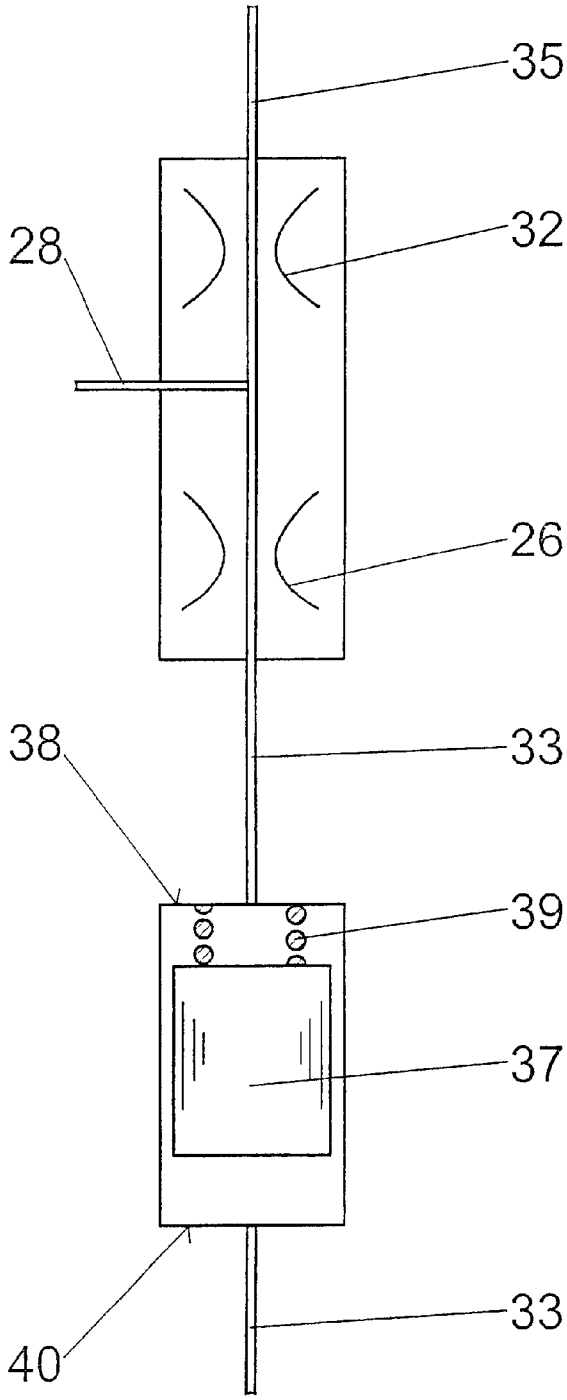
FIG. 3 is a simplified basic sketch of an addition to the embodiments shown in FIGS. 1 and 2.

FIG. 3, in a basic illustration, shows an addition to the embodiments of FIGS. 1 and 2, in which the hollow chamber 25 receiving at least the first throttle body 26 is preceded on the high-pressure side by a further hollow chamber 36 with a solid body 37 disposed in it. This solid body 37, which in the advantageous embodiment shown is embodied in pistonlike fashion, is disposed in the hollow chamber 36 axially movably and with a play by means of which it acts at least primarily as a filter for the throttling of the downstream first throttle body 26. Especially for a small throttle diameter of the first throttle body 26, which is often necessary in passenger cars, filtration of the high-pressure flow to the first throttle body 26 is advantageous. To prevent dirt particles from plugging up the throttle bore 27 of the throttle body 26, these particles that are larger than a predefined gap size are trapped by the piston 37. Because of the preferably large gap size around the piston 37, only a very slight throttling occurs as a result of this piston. The pressure divider function for adjusting the system pressure p_sys is thus effected only via the first throttle body 26 and the first piston 9 or the second throttle body 32.

At the same time, the axial mobility of the piston 37 acting as a filter assures that its gap size, which for instance can amount to from 10 $\mu$m to 15 $\mu$m, is such that the gap will not become plugged up with dirt particles. To assure at least an axial motion of the piston 37 in the event of pressure fluctuations, a spring device 39 is provided between the solid body or piston 37 and a stop 38 on the throttle side; by means of this spring device, if the high pressure p_R in the high-pressure region 17 drops, the piston 37 is displaceable against a stop 40 on the high-pressure side. Thus the piston 37 is moved in every turn-on and turn-off phase, and a result the piston gap is automatically created. To adjust the system pressure p_sys, the piston 37 is geometrically defined as a function of the parameters already discussed with regard to the throttle body dimensioning.

The fuel injection valve of FIGS. 1, 2 or 3 functions as described below.

In the closed state of the fuel injection valve 1, that is, when voltage is not applied to the piezoelectric actuator 4, the valve closing member 12 is seated on the upper valve seat 14 assigned to it and is pressed against the first valve seat 14, among other elements, by the spring 31 having the spring force F_F, and primarily by the rail pressure p_R.

In the case of a slow actuation, for instance as a consequence of temperature-dictated changes in length of the piezoelectric actuator 4 or other valve components, the first piston 9 acting as a control piston penetrates the compensation volume of the hydraulic chamber 13 in the event of temperature increases, and upon a temperature drop withdraws from it again, without affecting the closing and opening position of the valve closing member 2 and of the fuel injection valve 1 overall.

If the valve is to be opened and an injection is to take place through the fuel injection valve 1, then the piezoelectric actuator 4 is subjected to voltage, which causes it to suddenly expand axially. The piezoelectric actuator 4 is braced against the valve body 7 at this time and builds up an opening pressure in the hydraulic chamber 13. Not until the valve 1 is in equilibrium, as a result of the system pressure p_sys in the hydraulic chamber 13, does the second piston 11 force the valve closing member 12 out of its upper valve seat 14 into a middle position between the two valve seats 14 and 15. At a high rail pressure p_R, a greater force on the piezoelectric actuator side is required in order to reach the pressure of equilibrium in the hydraulic chamber 13. In the filling device 24 of the invention, however, if the rail pressure p_R is high, then the pressure in the hydraulic chamber 13 is also elevated accordingly. In this way, for the same voltage applied to the piezoelectric actuator 4, the force on the piezoelectric actuator side exerted on the valve closing member 12 is increased. This force increase is equivalent to a substantially higher voltage that would have to be applied to the piezoelectric actuator 4. The force reserve thus gained can be utilized in the design of the valve, for instance in order to reduce the size of the piezoelectric actuator.

To move the valve closing member 12 backward again into a middle position counter to the rail pressure p_R after it has reached its second, lower valve seat 15 and to attain a fuel injection again, the supply of electrical current to the piezoelectric actuator 4 is interrupted. Simultaneously with the return motion of the valve closing member 12, refilling of the hydraulic chamber 13 to the system pressure p_sys is effected via the filling device 24.

The versions described each pertain to a so-called double-seat valve, but the invention is understood to be applicable to single-switching valves having only one valve seat as well.

Nor is it obligatory that the line 33, leading to the high-pressure region 17, of the filling device 24 communicate, as it does in the preferred embodiments shown, with the valve chamber 18 in which the valve closing member 12 is movable between the valve seats 14 and 15. In alternative versions it can also be provided that the line 33 communicates fluidically with a high-pressure inlet from a high-pressure pump, for instance to the valve control chamber 2 in the high-pressure region 17, or with the outlet throttle 20.

The foregoing relates to preferred exemplary embodiments of the invention, it being understood that other variants and embodiments thereof are possible within the spirit and scope of the invention, the latter being defined by the appended claims.

I claim:

1. A valve for controlling fluids, comprising an actuator unit (4) for actuating a valve member (3), which is axially displaceable in a valve body and with which a valve closing member (12) is associated, which valve closing member cooperates with at least one valve seat (14, 15) for opening and closing the valve (1) and separates a low-pressure region (16) at system pressure from a high-pressure region (17), the valve member (3) having at least one first piston (9) and one second piston (11) between which a hydraulic chamber (13) functioning as a hydraulic booster is embodied, and a filling device (24) connectable to the high-pressure region (17) to compensate for leakage losses, the filling device (24) being embodied with at least one channel-like hollow chamber (25), in which at least one throttle body (26) is disposed in such a way that on one end of the throttle body (26), a line (33) leading to the high-pressure region (17) discharges into the hollow chamber, and that on the opposite end of the throttle body (26), a system pressure line (28) leading to the hydraulic chamber (13) branches off, wherein system pressure (p_sys), is controlled by the geometry of a throttle bore (27) in the throttle body (26) and by the dimensions of the first piston (9), wherein the system pressure (p_sys) is reduced toward the low-pressure region (16), and is built up by pressure (p_R) prevailing in the high-pressure region (17).

2. The valve of one of claim 1 wherein, the geometry of the at least one throttle body (26, 32) and/or the piston (9), along which the system pressure (p_sys) is reduced toward the low-pressure region (16), is selected as a function of at least the parameters of the seat diameter (A2) and the ratio of the diameter (A0) of the first piston (9) to the diameter (A1) of the second piston (11).

3. The valve of claim 1, further comprising a spring (31) having a spring force (F_F), the spring (31) being disposed between the valve closing member (12) and a second valve seat (51) toward the high-pressure region (17) and keeps the valve closing member (12) in the closing position on the first valve seat (14) upon relief of the high-pressure region (17), and is one parameter for determining the geometry of the at least one throttle body (26, 32) and/or of the piston (9), along which the system pressure (p_sys) is reduced toward the low-pressure region (16), and/or of the solid body (37) preceding the throttle body (26).

4. The valve of claim 1 wherein, the geometry of the ate least one throttle body (26, 32) and/or the piston 9 is effected such that the system pressure (p_sys) in the hydraulic chamber (13) is always less than a maximum allowable system pressure, and the maximum allowable system pressure of the hydraulic chamber (13) is preferably equivalent to a pressure at which an automatic valve opening ensues without actuation of the actuator unit (4).

5. The valve of claim 1 wherein, the at least one throttle body (26, 32) is embodied in sleevelike fashion.

6. The valve of claim 1 wherein, the system pressure line (28) leading to the hydraulic chamber (13) leads into the hydraulic chamber via a gap (29) adjoining the hydraulic chamber (13) and surrounding the first piston (9) and/or a gap (30) surrounding the second piston (11), preferably via the gap (29) surrounding the first piston (9).

7. The valve of claim 1 wherein, the line (33) leading to the high-pressure region (17) communicates fluidically with a high-pressure inlet from a high-pressure pump to a valve control chamber (2) into the high-pressure region (17), or with an outlet throttle (20) between the at least one valve seat (15) and the valve control chamber (2) in the high-pressure region (17), or preferably with a valve chamber (18), in which the valve closing member (12) is movable between a first valve seat (14) and a second valve seat (15).

8. The valve of claim 1 wherein, on the high-pressure side, the hollow chamber (25) receiving at least one throttle body (26, 32) is preceded by a further hollow chamber (36), with a solid body (37) disposed in it, and the solid body (37) is disposed therein with a play with which it serves at least primarily as a filter for throttling the downstream throttle body (26).

9. The valve of claim 8 wherein, the solid body (37) is disposed axially movably, and preferably between the pistonlike solid body (37) and a stop (38) on the throttle side a spring device (39) is provided, by means of which upon a drop in the pressure (p_R) in the high-pressure region (17), the solid body can be displaced against a stop (40) on the high-pressure side.

10. A valve for controlling fluids, comprising an actuator unit (4) for actuating a valve member (3), which is axially displaceable in a valve body and with which a valve closing member (12) is associated, which valve closing member cooperates with at least one valve seat (14, 15) for opening and closing the valve (1) and separates a low-pressure region (16) at system pressure from a high-pressure region (17), the valve member (3) having at least one first piston (9) and one second piston (11) between which a hydraulic chamber (13) functioning as a hydraulic booster is embodied, and a filling device (24) connectable to the high-pressure region (17) to compensate for leakage losses, the filling device (24) being embodied with at least one channel-like hollow chamber (25), in which a first throttle body (26) is disposed in such a way that on one end of the throttle body (26), a line (33) leading to the high-pressure region (17) discharges into the hollow chamber, and that on the opposite end of the throttle body (26), a system pressure line (28) leading to the hydraulic chamber (13) branches off, and system pressure (p_sys), is controlled by the geometry of a throttle bore (27) in the first throttle body (26) and a throttle bore (34) of a second throttle body (32), which is followed by a leakage line (35) branching off from the hollow chamber (25), wherein the system pressure decreases along the second throttle body (32) toward the low-pressure region (16).

11. The valve of one of claim 10 wherein, the geometry of the at least one throttle body (26, 32) and/or the piston (9), along which the system pressure (p_sys) is reduced toward the low-pressure region (16), is selected as a function of at least the parameters of the seat diameter (A2) and the ratio of the diameter (A0) of the first piston (9) to the diameter (A1) of the second piston (11).

12. The valve of claim 10, further comprising a spring (31) having a spring force (F_F), the spring (31) being disposed between the valve closing member (12) and a second valve seat (51) toward the high-pressure region (17) and keeps the valve closing member (12) in the closing position on the first valve seat (14) upon relief of the high-pressure region (17), and is one parameter for determining the geometry of the at least one throttle body (26, 32) and/or of the piston (9), along which the system pressure (p_sys) is reduced toward the low-pressure region (16), and/or of the solid body (37) preceding the throttle body (26).

13. The valve of claim 10 wherein, the geometry of the ate least one throttle body (26, 32) and/or the piston 9 is effected such that the system pressure (p_sys) in the hydraulic chamber (13) is always less than a maximum allowable system pressure, and the maximum allowable system pressure of the hydraulic chamber (13) is preferably equivalent to a pressure at which an automatic valve opening ensues without actuation of the actuator unit (4).

14. The valve of claim 10 wherein, the at least one throttle body (26, 32) is embodied in sleevelike fashion.

15. The valve of claim 10 wherein, the system pressure line (28) leading to the hydraulic chamber (13) leads into the hydraulic chamber via a gap (29) adjoining the hydraulic chamber (13) and surrounding the first piston (9) and/or a gap (30) surrounding the second piston (11), preferably via the gap (29) surrounding the first piston (9).

16. The valve of claim 10 wherein, the line (33) leading to the high-pressure region (17) communicates fluidically with a high-pressure inlet from a high-pressure pump to a valve control chamber (2) into the high-pressure region (17), or with an outlet throttle (20) between the at least one valve seat (15) and the valve control chamber (2) in the high-pressure region (17), or preferably with a valve chamber (18), in which the valve closing member (12) is movable between a first valve seat (14) and a second valve seat (15).

17. The valve of claim 10 wherein, on the high-pressure side, the hollow chamber (25) receiving at least one throttle body (26, 32) is preceded by a further hollow chamber (36), with a solid body (37) disposed in it, and the solid body (37) is disposed therein with a play with which it serves at least primarily as a filter for throttling the downstream throttle body (26).

18. The valve of claim 17 wherein, the solid body (37) is disposed axially movably, and preferably between the pistonlike solid body (37) and a stop (38) on the throttle side a spring device (39) is provided, by means of which upon a drop in the pressure (p_R) in the high-pressure region (17), the solid body can be displaced against a stop (40) on the high-pressure side.

* * * * *